US006880819B2

(12) United States Patent
Chen et al.

(10) Patent No.: US 6,880,819 B2
(45) Date of Patent: Apr. 19, 2005

(54) SHEET FEEDER CAPABLE OF IMMEDIATELY DETECTING A PAPER JAM

(75) Inventors: Michael Chen, Hsin Chu (TW); Chi-Yao Chen, Hsin Chu (TW)

(73) Assignee: Avision Inc., Hsinchu (TW)

( * ) Notice: Subject to any disclaimer, the term of this patent is extended or adjusted under 35 U.S.C. 154(b) by 148 days.

(21) Appl. No.: 10/394,054

(22) Filed: Mar. 24, 2003

(65) Prior Publication Data

US 2004/0130093 A1 Jul. 8, 2004

(30) Foreign Application Priority Data

Jan. 3, 2003 (TW) ..... 92200167 U

(51) Int. Cl.[7] ..... B65H 7/02; B65H 7/00
(52) U.S. Cl. ..... 271/58.01; 271/256; 399/21
(58) Field of Search ..... 271/58.01, 256; 399/21

(56) References Cited

U.S. PATENT DOCUMENTS 4,834,563 A * 5/1989 Ozawa et al. ..... 400/703
5,796,221 A * 8/1998 Cramer et al. ..... 318/68
6,536,762 B1 * 3/2003 Sheng et al. ..... 271/273

FOREIGN PATENT DOCUMENTS

JP 3-114860 * 5/1991 ..... B41J/17/36
JP 6-40603 * 2/1994 ..... B65H/7/06

* cited by examiner

*Primary Examiner*—Donald P. Walsh
*Assistant Examiner*—Kenneth W Bower
(74) *Attorney, Agent, or Firm*—Birch, Stewart, Kolasch & Birch, LLP

(57) ABSTRACT

A sheet feeder capable of immediately detecting a paper jam includes a housing, a motor attached to the housing, a driving roller, a driven roller, a rotation speed detector and a control circuit. The motor drives the driving roller to rotate, and the driving roller drives the driven roller to rotate. The driven roller cooperates with the driving roller to feed a sheet therethrough. The rotation speed detector detects the rotation speed of the driven roller and outputs a rotation speed signal. The control circuit receives the rotation speed signal to judge whether or not a paper jam occurs according to the rotation speed signal.

8 Claims, 6 Drawing Sheets

SHEET FEEDER CAPABLE OF IMMEDIATELY DETECTING A PAPER JAM

BACKGROUND OF THE INVENTION

1. Field of the Invention

The invention relates to a sheet feeder, and more particularly to a sheet feeder capable of immediately detecting a paper jam.

2. Description of the Related Art

Recently, a scanning device has become one of the widely used products in the office or personal application. Documents may be digitized by the scanning device, and also may be copied by the scanning device in conjunction with an output device such as a printer.

With the increase of the number of to-be-scanned documents, the conventional flat-bed scanner cannot be used to quickly scan the documents. Hence, a sheet-fed scanner and a flat-bed scanner in conjunction with a sheet feeder have become important products to meet the requirements.

A paper jam may sometimes occur when the sheet feeder feeds documents. The mostly used technology for detecting a paper jam in the sheet feeder is to cause the jammed paper to trigger some mechanism or sensor during the feeding procedure and then to inform the sheet feeder to stop.

In the above-mentioned technology, however, when the sheet feeder stops feeding the document, the jammed sheet may be damaged and cannot be well preserved.

Alternatively, it is possible to detect a paper jam by counting the time for a sheet to be fed to a predetermined position. Conventionally, a sheet detector may be provided in the sheet passage of the sheet feeder to detect whether or not the sheet has reached the position of the sheet detector in a predetermined period of time. If the sheet does not reach the detector in the predetermined period of time, it is judged that a paper jam has occurred.

According to the above-mentioned technology, a relatively long period of time has to be considered in order to completely and precisely judge a paper jam. For example, it is judged that a paper jam occurs if the sheet does not reach the sheet detector in five seconds after the sheet is fed. Because it is necessary to consider the manufacturing errors and safety factors, the judgement time may not be effectively shortened.

Consequently, it is an important subject of the invention to provide a sheet feeder capable of immediately detecting a paper jam.

SUMMARY OF THE INVENTION

It is therefore an object of the invention to provide a sheet feeder capable of immediately detecting a paper jam.

The invention achieves the above-mentioned object by providing a sheet feeder capable of immediately detecting a paper jam. The sheet feeder includes a housing, a motor attached to the housing, a driving roller, a driven roller, a rotation speed detector and a control circuit. The motor drives the driving roller to rotate, and the driving roller drives the driven roller to rotate. The driven roller cooperates with the driving roller to feed a sheet therethrough. The rotation speed detector detects the rotation speed of the driven roller and outputs a rotation speed signal. The control circuit receives the rotation speed signal to judge whether or not a paper jam occurs according to the rotation speed signal.

It is possible to judge whether or not a paper jam occurs by detecting the abnormal variation of the rotation speed of the driven roller.

DETAILED DESCRIPTION OF THE INVENTION

Figure 1:
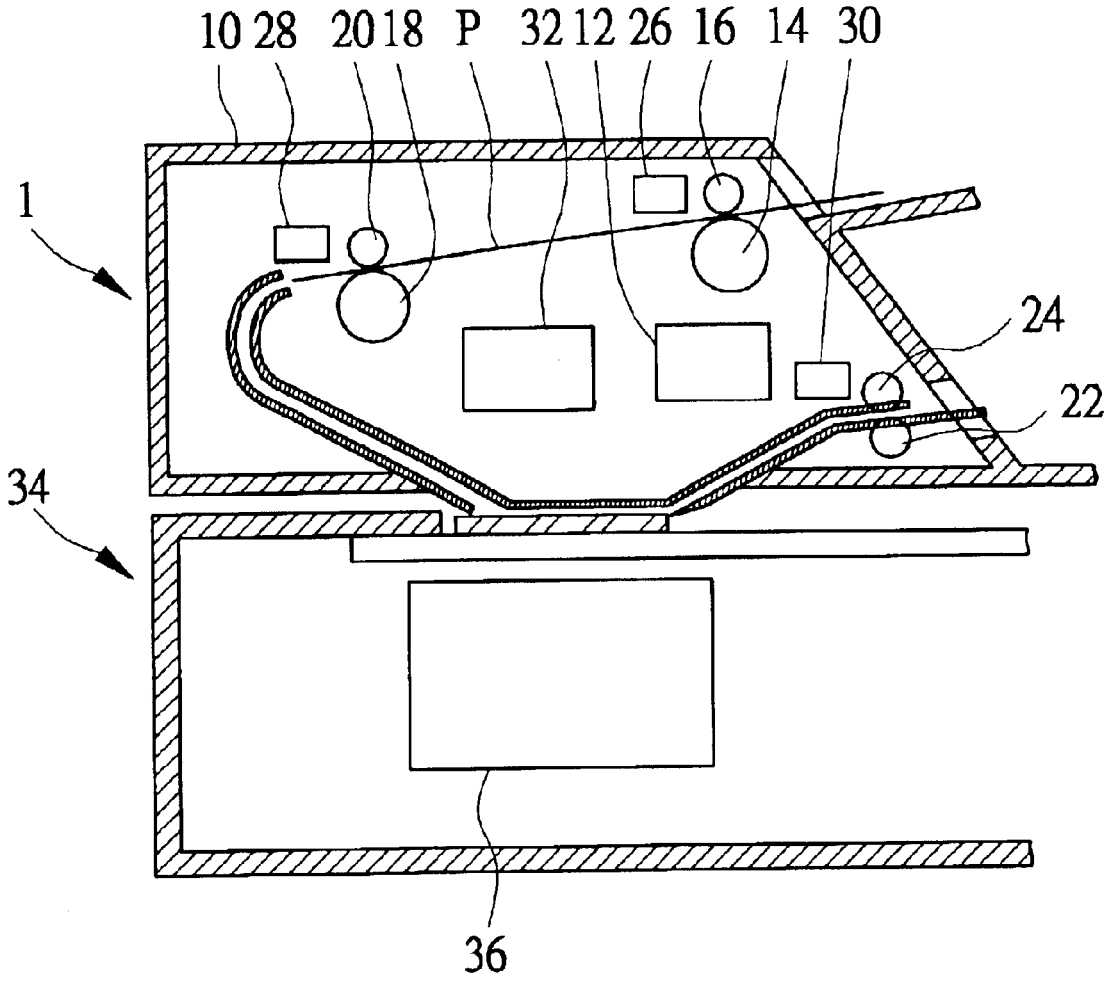
FIG. 1 is a schematic illustration showing a sheet feeder capable of immediately detecting a paper jam according to an embodiment of the invention.

Please refer to FIG. 1. A sheet feeder 1 according to an embodiment of the invention is mounted to a flat-bed scanner 34, which includes an optical module 36 for scanning a document. In fact, the sheet feeder 1 also may be combined with a fixed optical module to form a sheet-fed scanner.

The sheet feeder 1 includes a housing 10, a motor 12 attached to the housing 10, rotation speed detectors 26, 28 and 30, and a control circuit 32. The motor 12 drives a first driving roller 14 to rotate, and then the first driving roller 14 drives a first driven roller 16 to rotate. The motor 12 also drives a second driving roller 18 to rotate, and then the second driving roller 18 drives a second driven roller 20 to rotate. Similarly, the motor 12 also drives a third driving roller 22 to rotate, and then the third driving roller 22 drives a third driven roller 24 to rotate. The first rotation speed detector 26 detects a rotation speed of the first driven roller 16. If the rotation speed of the first driven roller 16 varies abnormally, it is judged that a paper jam occurs. Similarly, the second rotation speed detector 28 detects a rotation speed of the second driven roller 20 and the third rotation speed detector 30 detects a rotation speed of the third driven roller 24.

Although three sets of rotation speed detectors are employed to detect the rotation speeds of the driven rollers in this embodiment, more than three or less than three set(s) of rotation speed detector(s) may be employed. In addition, the rotation speed detectors, which respectively correspond to the specific driven rollers in the description hereinbelow, may be employed to detect the rotation speeds of all the driven rollers.

Since the sheet P is fed by the driving roller and the driven roller and the motor always drives the driving roller to rotate, the rotation speed of the driving roller does not vary abnormally. When a paper jam occurs, it means that the sheet cannot be driven at some position. Hence, the rotation speed of the driven roller varies abnormally. According to the above-mentioned principle, it is possible to judge whether or not a paper jam occurs by detecting the abnormal variation of the rotation speed of the driven roller.

It is to be noted that the abnormal variation of the rotation speed of the driven roller does not correspond to the variation of the rotation speed of the driven roller. In the design, the rotation speeds of the driving roller and the driven roller may vary at some stages or situations. For example, when the memory of a scanner is not enough during scanning, the motor has to stop for a period of time and then start after the memory is empty. Consequently, detecting the rotation speed variation may not judge a paper jam. However, the rotation speed of the motor and thus the rotation speed of the driving roller during sheet feeding are known. So, if the rotation speed of the driven roller during sheet feeding varies abnormally, the control circuit may easily judge that a paper jam occurs by detecting the abnormal variation of the rotation speed of the driven roller.

Figure 2:
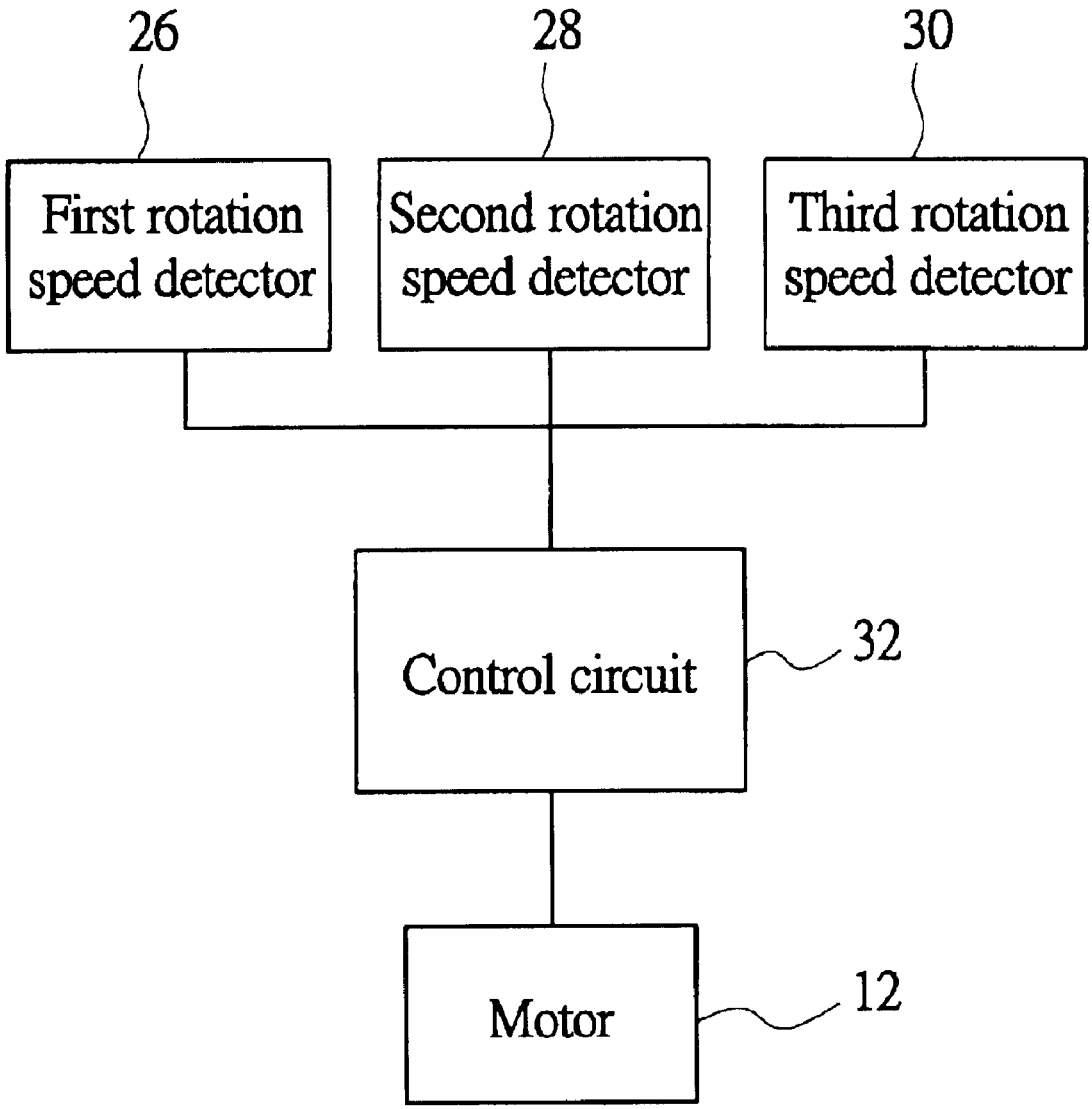
FIG. 2 is a schematic illustration showing the connection relationship among a rotation speed detector, a control circuit and a motor.

As shown in FIG. 2, the rotation speed detectors 26, 28 and 30 are coupled to the control circuit 32, which is coupled to the motor 12 to control the operation of the motor 12. The rotation speed detectors 26, 28 and 30 transfer the rotation speed signals, which are obtained by detecting the rotation speeds of the driven rollers, to the control circuit 32. The control circuit 32 judges the abnormal variation of the rotation speed of the driven roller to judge whether or not a paper jam occurs.

Figure 3:
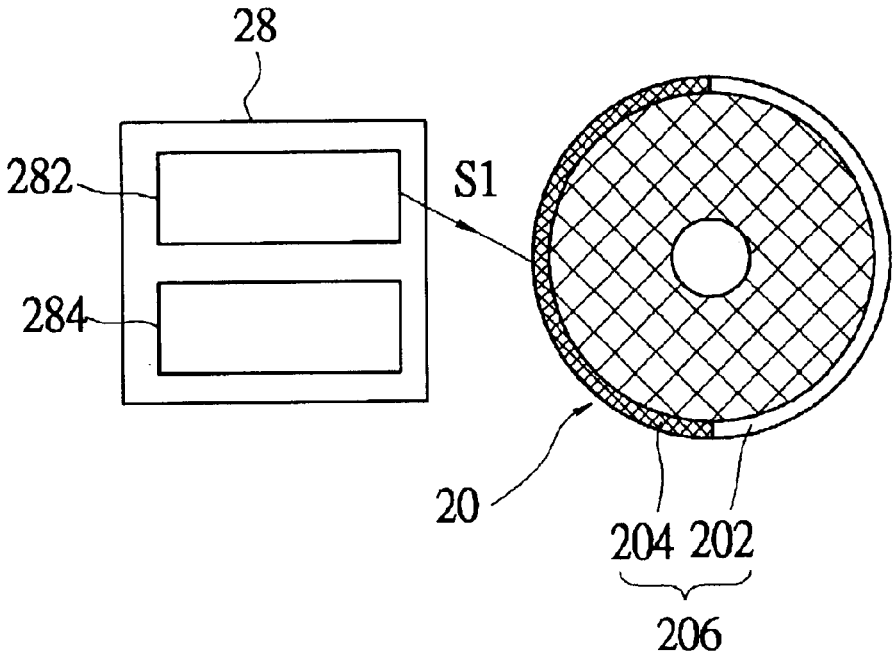
FIG. 3 is a schematic illustration showing a first state in a first arrangement of the rotation speed detector and the driven roller.
Figure 4:
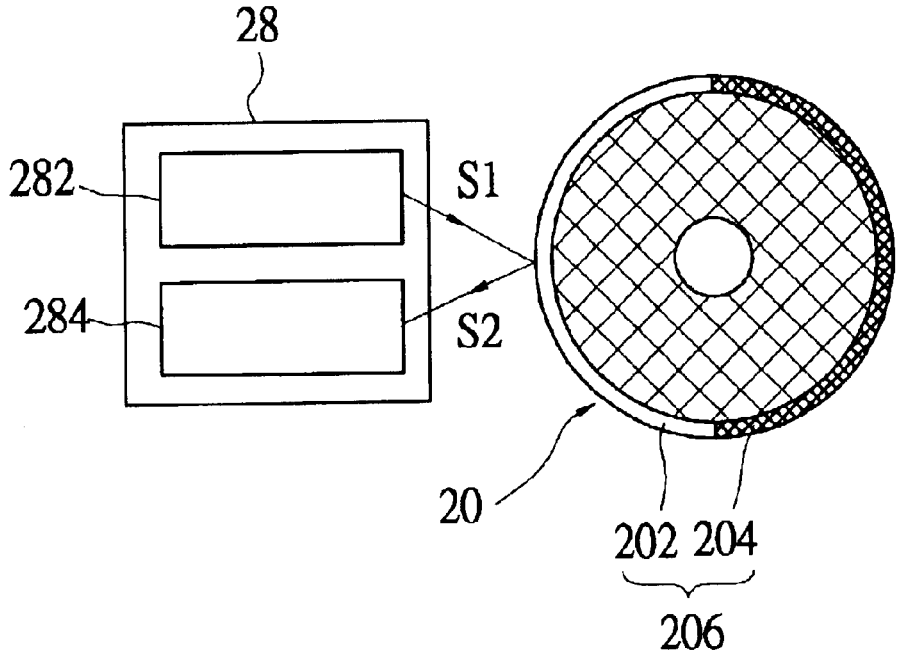
FIG. 4 is a schematic illustration showing a second state in the first arrangement of the rotation speed detector and the driven roller.

Referring to FIGS. 3 and 4, the second rotation speed detector 28 includes an emitter 282 and a receiver 284. The emitter 282 emits an incident signal S1 to the driven roller 20, and the receiver 284 receives a reflective signal S2 from the driven roller 20. The second driven roller 20 has a circumference 206 composed of two sections 202 and 204. The sections 202 and 204 have different reflective indexes with respect to the incident signal S1, so the reflective signal S2 varies with the rotation of the driven roller 20. For example, the sections 202 and 204 may be coated with paints having different colors. Consequently, in the states as shown in FIGS. 3 and 4, the receiver 284 receives different signals. The incident signal S1 may be, for example, an infrared signal or other signals.

Figure 5:
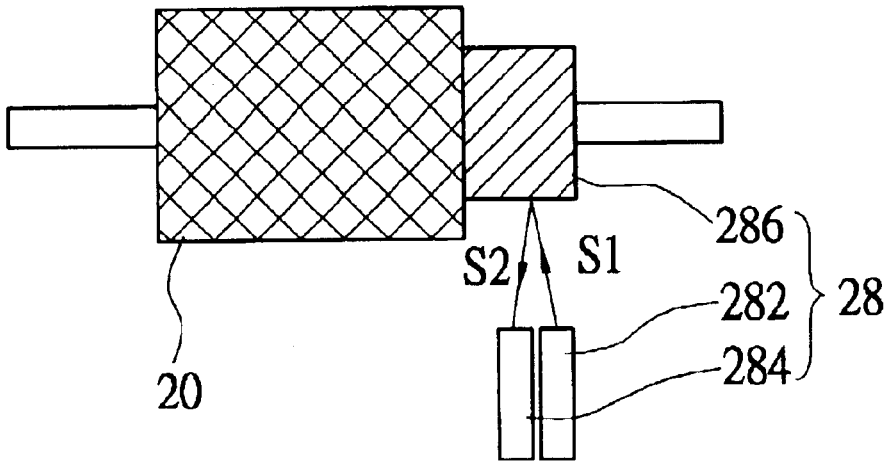
FIG. 5 is a schematic illustration showing a second arrangement of the rotation speed detector and the driven roller.

Referring to FIG. 5, the second rotation speed detector 28 includes an extension 286, an emitter 282, and a receiver 284. The extension 286 is fixed to the second driven roller 20 and rotated together with the second driven roller 20. The emitter 282 emits an incident signal S1 to the extension 286. The receiver 284 receives a reflective signal S2 from the extension 286. The reflective signal S2 varies with the rotation of the extension 286. In this configuration, the extension 286 may also have a plurality of sections similar to those of the driven roller 20 as shown in FIG. 3, and the sections have different reflective indexes with respect to the incident signal S1.

Figure 6:
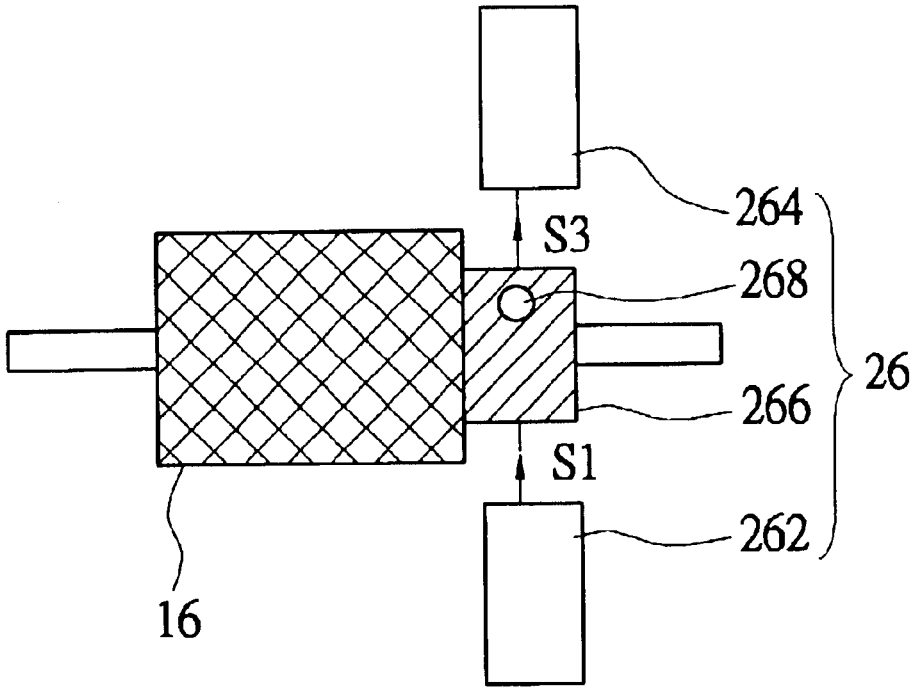
FIG. 6 is a schematic illustration showing a third arrangement of the rotation speed detector and the driven roller.

Referring to FIG. 6, the first rotation speed detector 26 includes an extension 266, an emitter 262, and a receiver 264. The extension 266 is fixed to the first driven roller 16 and rotated together with the first driven roller 16. The emitter 262 emits an incident signal S1 to the extension 266. The receiver 264 receives a passing signal S3 passing through the extension 266. The passing signal S3 varies with the rotation of the extension 266. The extension 266 may be formed with a through hole 268, through which the incident signal S1 may pass and travel to the receiver 264.

Similarly, it is also possible to form a through hole in the driven roller and to employ the emitter and receiver of FIG. 6 to detect the variation of the rotation speed of the driven roller. In addition, the extension 266 is not limited to a cylinder, but may be any structure which may cause the passing signal to vary with the rotation of the driven roller.

Figure 7:
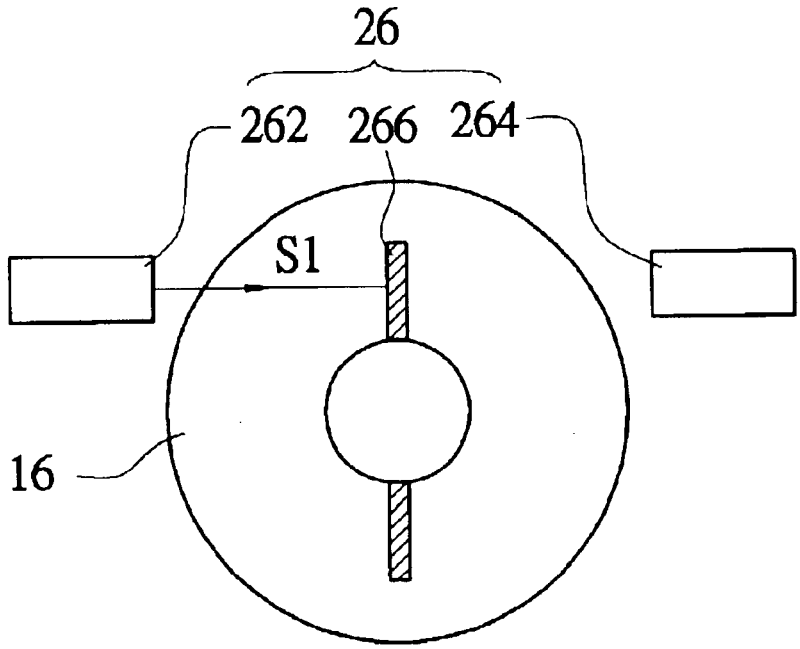
FIG. 7 is a schematic illustration showing a fourth arrangement of the rotation speed detector and the driven roller.
Figure 8:
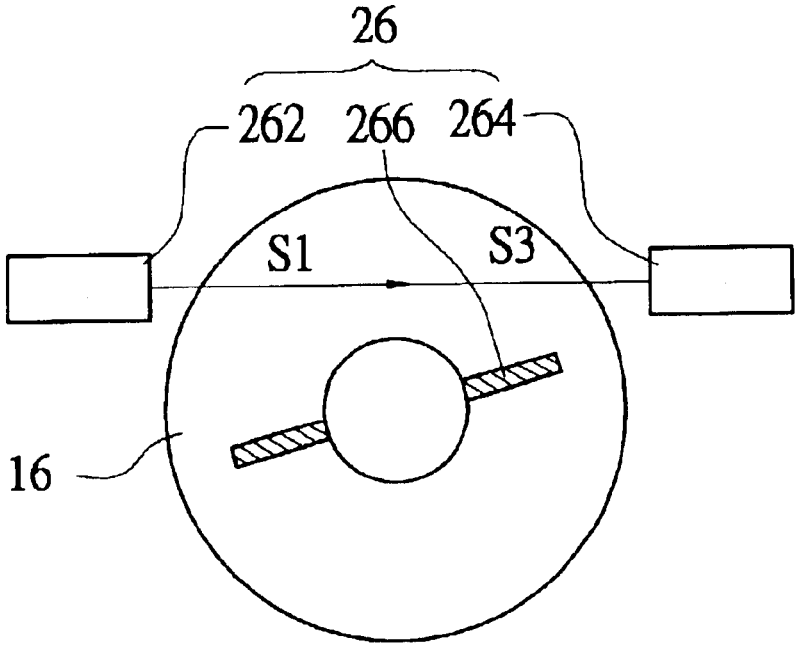
FIG. 8 is a schematic illustration showing a fifth arrangement of the rotation speed detector and the driven roller.

For example, as shown in FIGS. 7 and 8, the extension 266 may be a blocking member that is rotated together with the first driven roller 16. In the practical design, any stopper that may selectively block the incident signal may also be adopted in the above-mentioned embodiment of the invention. When the state of the extension 266 is that as shown in FIG. 7, the extension 266 blocks the incident signal S1, and the receiver 264 cannot receive any passing signal S3. When the state of the extension 266 is that as shown in FIG. 8, the extension 266 does not block the incident signal S1 and the receiver 264 can receive the passing signal S3. Accordingly, the passing signal S3 received by the receiver 264 may vary with the rotation of the first driven roller 16.

Figure 9:
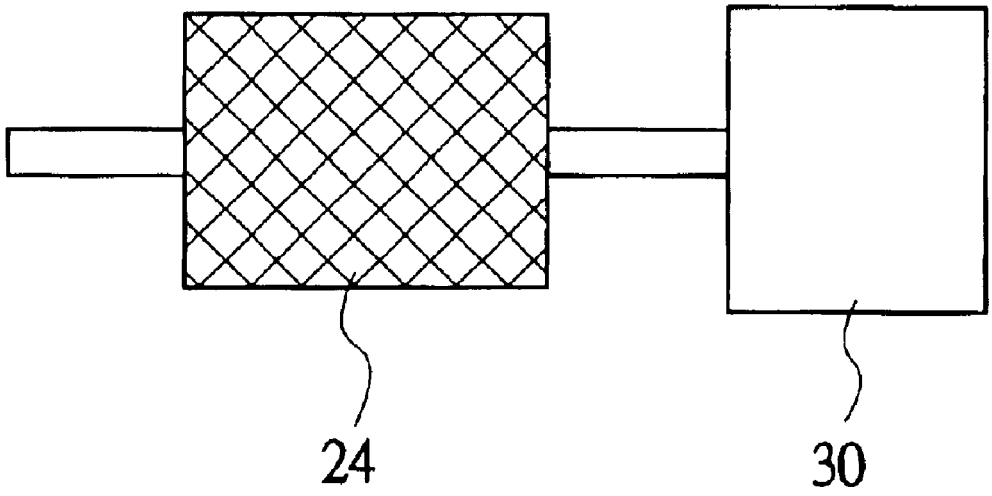
FIG. 9 is a schematic illustration showing an arrangement of a speed meter and the driven roller.

As shown in FIG. 9, the third rotation speed detector 30 may be a speed meter that is directly coupled to the third driven roller 24 to directly detect the rotation speed of the third driven roller 24. The speed meter that may be used may be a current type, a voltage type, or a magnetic type speed meter.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. A sheet feeder capable of immediately detecting a paper jam, the sheet feeder comprising:

a housing;

a motor attached to the housing;

a driving roller driven to rotate by the motor;

a driven roller driven to rotate by the driving roller, the driven roller and the driving roller cooperating to feed a sheet therethrough;

a rotation speed detector for detecting a rotation speed of the driven roller and outputting a rotation speed signal; and a control circuit for receiving the rotation speed signal and judging whether or not the paper jam occurs according to the rotation speed signal.

2. The sheet feeder according to claim 1, wherein the rotation speed detector comprises:

an emitter for emitting an incident signal to the driven roller; and a receiver for receiving a reflective signal from the driven roller, the reflective signal varying with rotation of the driven roller.

3. The sheet feeder according to claim 1, wherein the driven roller has a circumference composed of plural sections, which have different reflective indexes with respect to the incident signal.

4. The sheet feeder according to claim 1, wherein the rotation speed detector comprises:

an emitter for emitting an incident signal to the driven roller; and a receiver for receiving a passing signal passing through the driven roller, the passing signal varying with rotation of the driven roller.

5. The sheet feeder according to claim 1, wherein the rotation speed detector comprises:

an extension fixed to the driven roller and rotated together with the driven roller;

an emitter for emitting an incident signal to the extension; and a receiver for receiving a passing signal passing through the extension, the passing signal varying with rotation of the extension.

6. The sheet feeder according to claim 1, wherein the rotation speed detector comprises a speed meter coupled to the driven roller to detect the rotation speed of the driven roller.

7. The sheet feeder according to claim 1, wherein the rotation speed detector comprises:

an extension fixed to the driven roller and rotated together with the driven roller;

an emitter for emitting an incident signal to the extension; and a receiver for receiving a reflective signal from the extension, the reflective signal varying with rotation of the extension.

8. The sheet feeder according to claim 7, wherein the extension has a circumference composed of plural sections, which have different reflective indexes with respect to the incident signal.

* * * * *